United States Patent [19]

Meechan et al.

[11] 4,158,938

[45] Jun. 26, 1979

[54] FOAMED PLASTIC PANEL CONNECTING MEANS AND WALL STRUCTURE

[75] Inventors: Robert M. Meechan, Sacramento; Gabriel V. Gallina, Carmichael, both of Calif.

[73] Assignee: Owens-Corning Fiberglas Corporation, Toledo, Ohio

[21] Appl. No.: 839,729

[22] Filed: Oct. 5, 1977

[51] Int. Cl.[2] ..... E04C 1/30

[52] U.S. Cl. ..... 52/463; 52/309.11; 52/587

[58] Field of Search ..... 52/461, 309.11, 584, 52/586, 587, 463–469

[56] References Cited

U.S. PATENT DOCUMENTS

| | | | |
|---|---|---|---|
| 2,232,793 | 2/1941 | Lowry | 52/463 X |
| 3,082,849 | 3/1963 | Keller | 52/466 X |
| 3,127,639 | 4/1964 | Hammitt et al. | 52/464 X |
| 3,153,692 | 10/1964 | Lindgren | 52/463 X |
| 3,197,929 | 8/1965 | Halbostad | 52/463 X |
| 3,199,258 | 8/1965 | Jentoft et al. | 52/468 X |
| 3,398,496 | 8/1968 | Mischke | 52/463 |
| 3,512,819 | 5/1970 | Morgan et al. | 52/465 X |
| 3,675,954 | 7/1972 | Konig | 52/584 X |
| 4,067,155 | 1/1978 | Ruff et al. | 52/466 X |

FOREIGN PATENT DOCUMENTS

| | | | |
|---|---|---|---|
| 510078 | 4/1952 | Belgium | 52/463 |
| 740595 | 8/1966 | Canada | 52/463 |
| 893858 | 11/1953 | Fed. Rep. of Germany | 52/463 |
| 2143171 | 3/1973 | Fed. Rep. of Germany | 52/469 |
| 1293103 | 4/1962 | France | 52/466 |

*Primary Examiner*—J. Karl Bell

*Attorney, Agent, or Firm*—Ronald C. Hudgens; Philip R. Cloutier; Paul J. Rose

[57] ABSTRACT

At each joint between pairs of adjacent foam panels, a vertical edge portion of one of the panels encases a major portion of the periphery of each of a plurality of vertically spaced cylindrical double socket members and a vertical edge portion of the other of the panels is correspondingly recessed to receive minor portions of the periphery of the socket members protruding from the one panel. Also at each joint, two vertically elongated clamps are secured respectively on opposite sides of the panels by pairs of screws, the screws of each pair being threaded respectively into opposite sockets of one of the double sockets. Opposite vertical edge portions of each clamp are vertically grooved on the side of the clamp facing the panels for respectively receiving a pair of gaskets.

1 Claim, 5 Drawing Figures

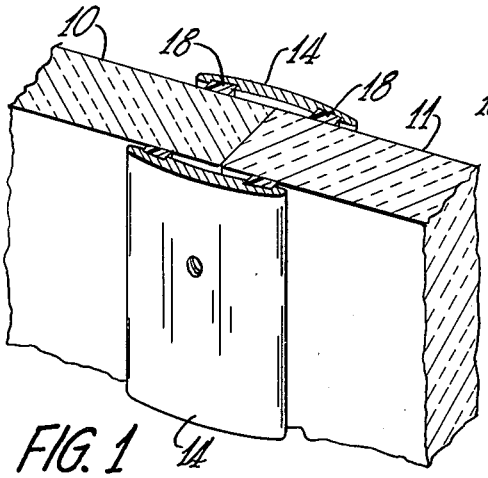
FIG. 1
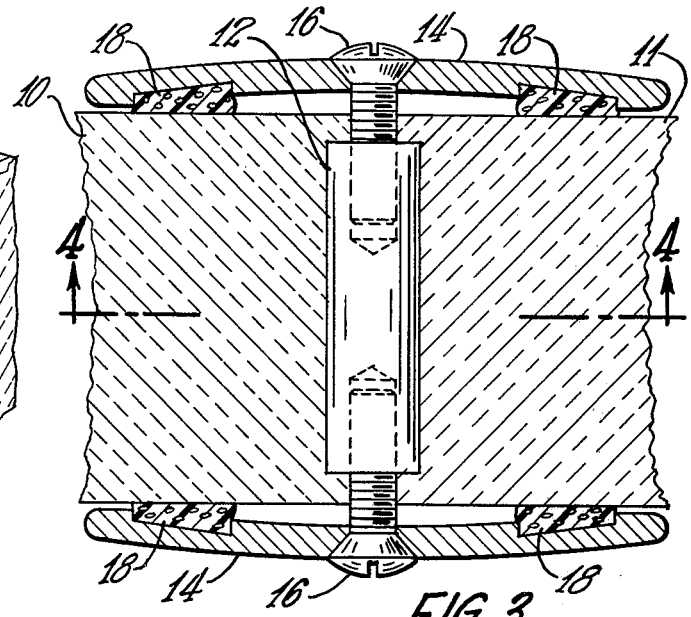
FIG. 3
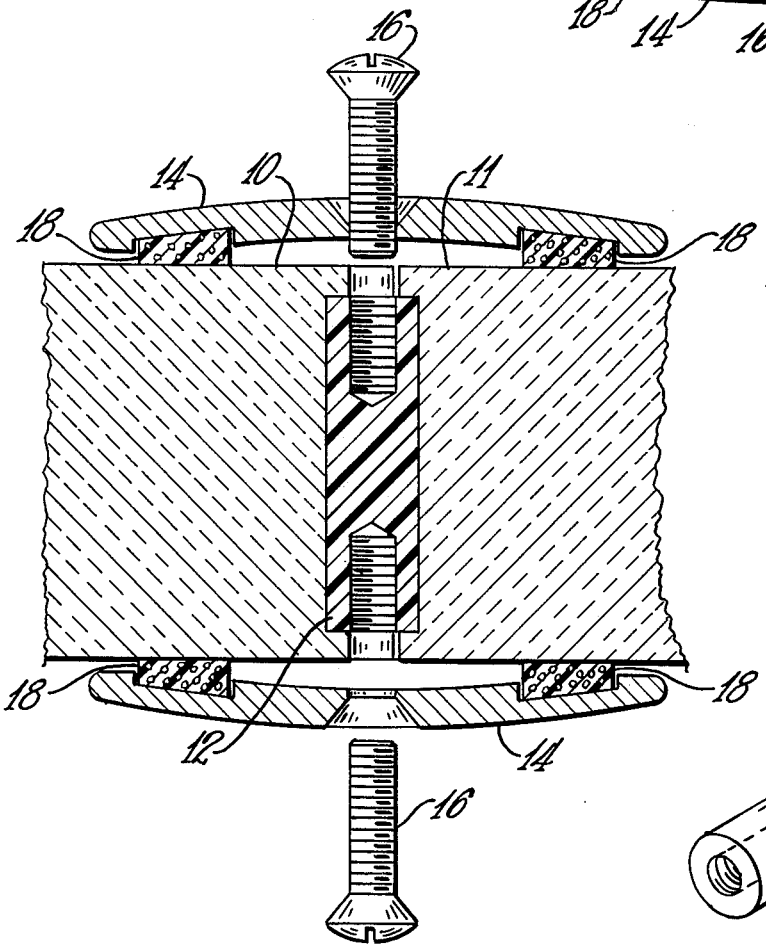
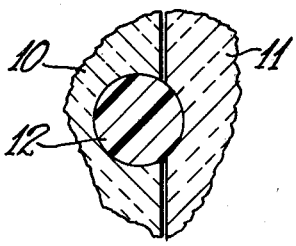
FIG. 4
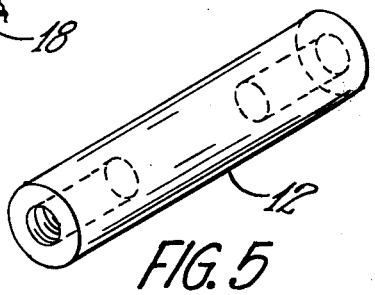
FIG. 5

FOAMED PLASTIC PANEL CONNECTING MEANS AND WALL STRUCTURE

This invention relates generally to rooms formed by or lined with foam panels and used principally for cold storage. More particularly, the invention relates to means for connecting adjacent foam panels.

Prior to our invention, foam panels were sometimes connected by composite H-shaped frame members without compression. At each panel joint, each panel had to be caulked on both sides at the vertical edge portions of the frame member. A considerable amount of labor was required for installation of the panels. Further, to replace a damaged panel, an entire wall of the panels had to be dis-assembled.

In accordance with our invention, panels are clamped on opposite sides at each joint by clamps carrying gaskets, whereby a positive seal against vapor transmission is provided. Caulking is eliminated. Considerably less labor is required for installation of the panels. Further, a single panel can be readily removed for replacement. With suitable brackets, the panels can be installed as a suspended ceiling. In addition, the clamps at each joint provide structural rigidity to a series of panels.

An object of the invention is to provide an improved foam panel connecting means useful in constructing cold storage rooms.

Another object is to provide a foam panel connecting means whereby a single panel of a room formed by or lined with panels may be readily removed for repair or replacement.

Other objects and advantages will become apparent when the following specification is considered along with the accompanying drawings in which:

FIG. 1 is a fragmentary perspective view of the foam panel connecting means of our invention;

FIG. 2 is a horizontal sectional view of the panel connecting means of FIG. 1, taken through one of the double sockets and showing the screws in position for insertion into the socket;

FIG. 3 is a view similar to FIG. 2, but showing the double socket in full with the screws mounted therein and the clamps tightened;

FIG. 4 is a fragmentary vertical sectional view taken along the line 4—4 of FIG. 3; and FIG. 5 is a perspective view of one of the double sockets.

With respect to the drawings, FIGS. 1 to 4 show a pair of adjacent foam panels 10 and 11 with the connecting means of the invention. Preferably the panels 10 and 11 are made of urethane foam and are faced on opposite sides with aluminum foil. A typical panel is four feet wide, eight feet high, and from three to six inches thick.

The connecting means includes a plurality of vertically spaced cylindrical double socket members 12 preferably made of a plastic such as Nylon and best shown in FIG. 5. The double sockets 12 may be made by cutting a rod into pieces of desired length and drilling and tapping each piece respectively at opposite ends to form sockets for a pair of screws. As best shown in FIG. 4, a major portion of the periphery of each of the double sockets 12 is encased in a vertical edge portion of the foam panel 10, the protruding minor portion of the periphery being receivable in an appropriate recess in the adjacent vertical edge portion of the foam panel 11. The double sockets 12 may be spaced about two feet apart along a vertical edge portion of a foam panel.

The connecting means at the joint between the panels 10 and 11 also includes a pair of vertically elongated generally flat clamping members 14 preferably extruded of aluminum and secured respectively on opposite sides of the panels by pairs of screws 16, the screws of each pair being threaded respectively into opposite sockets of one of the double sockets 12. Opposite vertical edge portions of each of the clamps 14 are vertically grooved on the side of the clamp facing the panels, a pair of continuous gaskets 18, preferably formed of closed-cell foamed polyethlene, being received respectively in the grooves. When the screws 16 are tightened, the gaskets 18 are compressed, as best shown in FIG. 3, providing a positive seal against vapor transmission, and the clamps 14 provide structural rigidity across the joint between the panels 10 and 11.

Various modifications may be made in the structure shown and described without departing from the spirit and scope of the invention.

We claim:

1. A generally rectangular foamed plastic wall panel having opposed first and second vertical edge portions and including a plurality of non-metallic double socket members vertically spaced from each other along the first vertical edge portion, a major portion of the periphery of each double socket member being encased in the first vertical edge portion, and each socket member having a pair of sockets opening respectively to opposite sides of the panel for respectively receiving a pair of screws when it is desired to clamp the first vertical edge portion of the panel to the second vertical edge portion of a like panel by a pair of generally flat elongated clamping members disposed respectively on opposite sides of the panels.

* * * * *